United States Patent [19]

Barnes et al.

[11] Patent Number: 4,724,828

[45] Date of Patent: Feb. 16, 1988

[54] CERVICALLY ADJUSTABLE CHIROPRACTIC TREATMENT TABLE

[75] Inventors: James E. Barnes, 4410 Arden Dr., Fort Wayne, Ind. 46804; James Morkoetter, Fort Wayne, Ind.

[73] Assignee: James E. Barnes, Ft. Wayne, Ind.

[21] Appl. No.: 834,427

[22] Filed: Feb. 28, 1986

Related U.S. Application Data

[63] Continuation-in-part of Ser. No. 667,340, Nov. 1, 1984, Pat. No. 4,649,905.

[51] Int. Cl.[4] ..... A61H 1/02

[52] U.S. Cl. ..... 128/74

[58] Field of Search ..... 128/70–74, 128/33; 269/324–326; 5/71–73, 74 R, 74 B, 75–79, 66–69

[56] References Cited

U.S. PATENT DOCUMENTS

| | | | |
|---|---|---|---|
| 1,145,503 | 7/1915 | Naysmith | 128/73 |
| 1,282,580 | 10/1918 | Hosford et al. | 128/71 |
| 1,286,183 | 11/1918 | McManis et al. | 128/74 |
| 1,410,476 | 3/1922 | Keane | 128/33 |
| 1,936,363 | 11/1933 | Murray | 128/74 |
| 2,208,502 | 7/1940 | Kjelgaard | 128/72 |
| 2,290,407 | 7/1942 | Collins | 128/33 X |
| 4,230,100 | 10/1980 | Moon | 128/73 X |
| 4,649,905 | 3/1987 | Barnes | 128/70 X |

*Primary Examiner*—Clifford D. Crowder

*Attorney, Agent, or Firm*—Pearne, Gordon, McCoy & Granger

[57] ABSTRACT

A headpiece and headpiece coupling arrangement to be used in conjunction with a chiropractic treatment table, allowing the practitioner to select any one or more of six different modes of movement of the headrest relative to the main portion of the treatment table is disclosed. In addition to the somewhat conventional pivotal motion about a horizotal axis, the present invention provides the practitioner with pivotal motion about a vertical axis, linear extensin or traction, rotation of the headpiece about a longitudinal axis coinciding with the patient's spinal column, auxiliary flexion of the headpiece about a horizontal axis, and an abrupt limited motion for bringing a patient's head forward and downwardly, imparting a snapping action to the cervical spine. The latter two modes of movement are mechanically linked to the rotation of the headpiece.

21 Claims, 12 Drawing Figures

CERVICALLY ADJUSTABLE CHIROPRACTIC TREATMENT TABLE

RELATED APPLICATION

This is a continuation-in-part of copending application Ser. No. 667,340, filed Nov. 1, 1984, now U.S. Pat. No. 4,649,905.

BACKGROUND OF THE INVENTION

The present invention relates generally to chiropractic treatment tables of the type for generally horizontally supporting a patient in a face-down position and, more particularly, to such tables having a wide latitude of variability in orienting and moving the cervical portion of the patient's spine. With such an arrangement, a chiropractor or other practitioner can select appropriate positions and motions tailored to the particular patient's disorder of the cervical curve of the spinal column.

The treatment of various maladies of the human body by means of the manipulation of the muscles and skeletal structure thereof, commonly referred to as "chiropracty," has become a widely used and accepted art. Various apparatuses have been developed to facilitate this type of treatment, one such apparatus being an articulated treatment table. Such tables, such as, for example, the "Barnes Flexion-Distraction" manufactured by Custom Tool, Inc., Fort Wayne, Ind. typically include an elongated, padded platform or table on which a patient can recline. The table is further provided with means for securing the patient's extremities, e.g., the patient's ankles, and includes an articulated lower anterior body section which underlies the patient adjacent the lower back. The table provides means for tiltably raising and lowering (extension and flexion, respectively), laterally bending, rotating and extending the anterior body section with respect to the upper body or support section. Such treatment tables have proven to be valuable aids to the practitioner of chiropractic medicine and various treatments for patients suffering from spinal and related nerve, muscle, and skeletal maladies have been devised using such tables. Among the many options available on the tables manufactured by the assignee of the present invention have been power-driven or automated arrangements for moving the anterior body section with respect to the upper body support as illustrated in U.S. Pat. No. 4,489,714, and arrangements for tilting about a transverse horizontal axis and a headrest segment of the upper body support section of the table. Such tilting of a headrest about a transverse horizontal axis is also illustrated in U.S. Pat. No. 1,938,006.

Each of the aforementioned arrangements for tilting or pivoting the headrest portion of a chiropractic table relative to the main support arrangement of that table have been limited to a single degree of freedom, namely, pivotal motion of the headrest about a transverse horizontal axis, generally separating that headrest portion from the main body of the table. Such a pivotal motion is highly desirable in treating certain disorders of the cervical portion of the spine; however, it is frequently desirable for the practitioner to be able to move the cervical portion of the spinal column in other than a simple forward tipping motion. With these prior treatment tables, such other motions could only be accomplished by the doctor physically moving the patient's head relative to the head support portion of the table. It is therefore highly desirable for the practitioner to have a wider variety of table support motions available to him.

U.S. Pat. No. 4,649,905 provides such a variety. According to that application, a patient having a disorder of the cervical curve portion of the spinal column may be treated by supporting the patient in a generally horizontal, face-down attitude on a chiropractic treatment table, with the patient's body resting on a first table portion such as a body support section, and the patient's head resting on a second table portion such as a headpiece, which is selectively movable relative to the first table portion, the practitioner thereafter simultaneously moving the patient's head and the table headpiece relative to the patient's body and the first table in a manner so that the head and body continuously remain in contact with the respective table portion and with that movement including one or more of the following motions:

rotation or pivotal motion about a horizontal, longitudinal axis passing lengthwise along the patient and through a cervical portion of the patient's spine, thus allowing a twisting motion from side-to-side to be imparted to the patient's head;

rotation or pivotal motion about a generally vertical axis extending generally perpendicular to and through a cervical portion of the patient's spine, thus allowing a lateral flexion or side-to-side head motion in a generally horizontal plane;

a tilting forward and backward or vertical flexion of the patient's head by pivotal motion of the head support about a generally horizontal transverse axis which was, prior to the present invention, the motion available with the above-noted prior art devices;

a linear translation to stretch a cervical portion of the patient's spine to induce a traction in the cervical spine portion; and a snap action or drop wherein the headpiece executes an abrupt oblique linear translation downward and away from the main body support section of the table, imparting a stretching and forward snapping action to a cervical portion of the patent's spine.

According to applicant's U.S. Pat. No. 4,649,905, rotation or pivotal motion about a horizontal, longitudinal axis passing lengthwise along the patient and through the cervical portion of the patient's spine is accomplished by an improved mechanical coupling which includes an elongated support bar articulately coupled near one end thereof to the body support section of the table and a pair of arcuate rails fixed to the head support section and relatively movable along a pair of rail-receiving fixtures on the support bar. The rails are formed in the general configuration of portions of circles, the centers of which coincide with the longitudinal axis. The rail-receiving fixtures may include a plurality of rail-engaging rollers along with a manually actuable clamp for selectively securing the rail section to the fixture at a preferred rotational orientation of the head support section relative to the body support section. The head support, arcuate rails, and fixtures may be longitudinally movable along the support bar and the support bar articulately coupled to the body support section to provide desired traction, vertical flexion, and lateral flexion of a patient's spine portion.

SUMMARY OF THE INVENTION

While all of the above-described features result in a wider variety of positions of the patient's body and enable the practitioner to maintain a greater degree of control over those positions, the present invention provides a treatment table having even greater flexibility and body control. According to that copending application, the head support section may be abruptly translated through a limited distance obliquely downward and away from the body support section due to the presence of a sliding interconnection forming part of the articulate coupling. This arrangement enables the practitioner to perform the snap action or drop while the patient's head is in a rotated position relative to the spinal column. However, since the mechanism permitting the drop is formed as part of the articulate coupling between the headpiece and the body support sections of the treatment table, the drop is always downwardly in a fixed path independent of any rotated position of the headrest, since practitioners customarily perform the snap or drop motion downwardly and in a plane perpendicular to the main body support. They, therefore, may tend to avoid a drop when the headpiece is in a rotated position, since the drop would exert a displacing motion with respect to the natural curvature of the spine.

As was previously noted, the tilting and backward or vertical flexion of the patient's head is also about a generally horizontal, transverse axis which passes through the articulate coupling. This axis is substantially displaced downwardly from the surface of the body support section of the table, and tends to displace the entire headpiece downwardly or upwardly relative to the surface of the main support portion of the table.

According to the present invention, a chiropractic table is provided having the aforementioned five degrees of freedom provided by the table set forth in U.S. Pat. No. 4,649,905 and provides an improved mechanism for providing a drop or snap action in a direction which is fixed with respect to the headpiece for all rotated positions of the headpiece,, thus providing a more natural and controlled movement for the practitioner. Furthermore, according to this invention, the degree or length of travel of the drop may be adjustably selected by the practitioner. A mechanism is provided which will releasably lock the headpiece in a first or raised position and which will be released as a function of applied pressure. The practitioner may establish a reference point for a particular patient by adjusting the release mechanism and permitting the patient's head to drop without applying external pressure and then setting the release mechanism to a desired predetermined release pressure beyond that pressure exerted by the patient's head.

An additional degree of freedom is provided by pivoting the headpiece relative to a carriage which may be rotated in an arcuate track, so that by adjusting the pivoted attitude of the headpiece in conjunction with a pivoted attitude of the articulate coupling, a more precise control is maintained over the flexion or extension of the patient's spine in the neck area of the patent.

These functions are obtained by a mechanism which provides arcuate movement of the headpiece about a cervical axis spaced above the plane of the table and parallel to a longitudinal axis of the treatment table. A locking mechanism is provided which locks the headrest in any one of a multiplicity of positions along an arc. The mechanism provides at least one additional degree of freedom for the headpiece in a direction located in a plane normal to the headpiece and passing through the cervical axis when the headpice is in any one of its rotated positions. According to narrower aspects of this invention, two additional degrees of freedom are provided, with one of the degrees of freedom being arcuate about an axis passing through the headpiece and the other one of the degrees of freedom being rectilinear and mechanically linked to the rotated carriage carrying the headpiece.

DETAILED DESCRIPTION OF THE INVENTION

Figure 1:
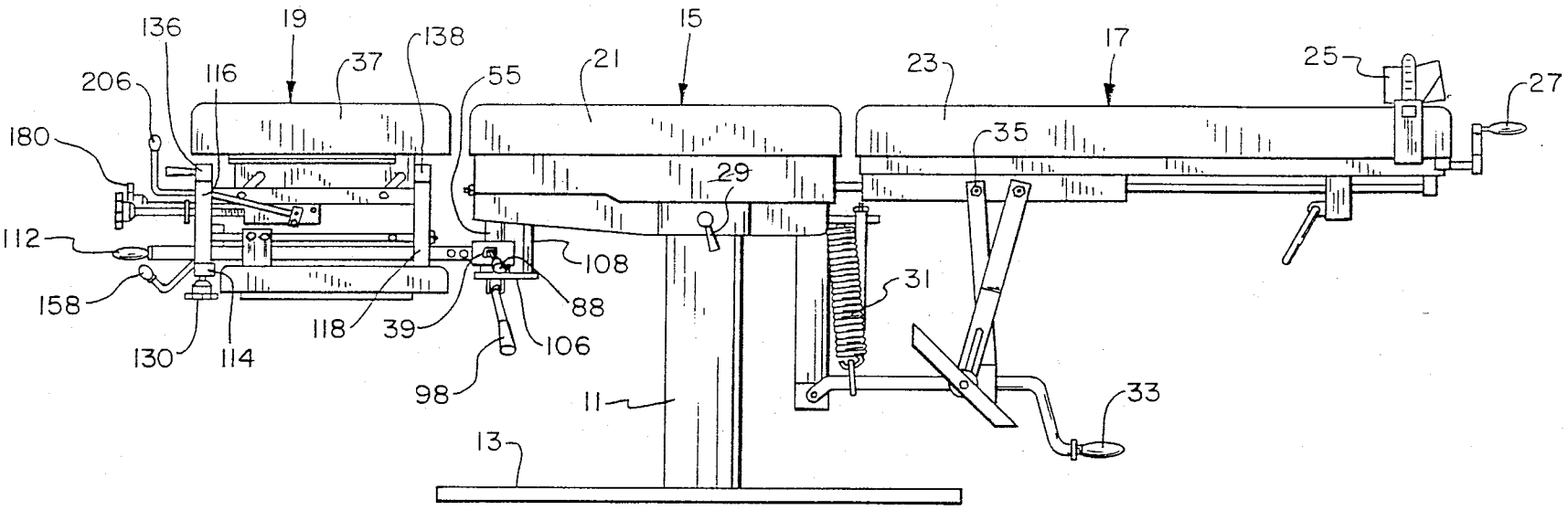
FIG. 1 is a side elevational view of a chiropractic treatment table in accordance with a preferred embodiment of the present invention.

Referring now to the drawings, and in particular to FIG. 1, there is illustrated a chiropractic treatment table incorporating a presently preferred embodiment of the present invention. Generally speaking, the treatment table of FIG. 1 is of the type having a support pedestal 11 resting on a floor-engaging base 13 and having an upper body support section 15 resting on the pedestal 11. An anterior body support portion 17 extends from the main body support portion and the pedestal 11 toward the right as viewed, while a headpiece or head support portion 19 extends from the upper body support section 15 toward the left as viewed. The upper body support section 15 and the anterior portion 17 for supporting a lower portion of the patient's body, as well as the relationship between those two sections, and the support pedestal 11 are largely conventional and may, for example, be constructed such as in the aforementioned copending applications for the aforementioned known devices.

Briefly, the uppermost portions of the upper body support section and the anterior support section 17 comprise cushions 21 and 23 upon which a patient may rest in a prone or face-down, generally horizontal position during treatment. Examination and treatment of numerous lubar and lower thoracic spinal column disorders are facilitated by the numerous relative motions between the upper body support section 15 and the anterior support section 17, which are selectively available to the practitioner. For example, traction in the general direction of elongation of a patient's spinal column, with the patient's ankle secured in stirrups 25, may be induced by rotation of a crank handle 27. Lateral flexion, i.e., moving the lower support section 23 pivotally about the support pedestal 11 in a horizontal plane, is achieved by releasing a locking handle (not shown). Flexion, i.e., pivotal motion of the lower body support section 17 about a horizontal axis, is facilitated by a pair of tension springs 31 which tend to oppose or counterbalance the weight of the patient's lower body section on section 23, with spring tension being under the control of the handle 33 and selectable to match the weight of a particular patient. The lower body support section may also be rotated about a generally longitudinal, horizontal axis passing approximately through the elevation of the pivot 35. The relative motions between the main body 15 and the lower body or anterior support sections 17, as thus far discussed, are conventional and, while present in both the applicant's presently preferred embodiment of the present invention and in the known prior art, are optional to any particular embodiment of the present invention.

In the known prior art chiropractic treatment tables, the headpiece 19, including an upper headrest cushion, was formed either with the cushions 37 and 21 as an integral one-piece cushion or, in some cases, as two separate cushion portions, the headrest of which was pivotable only about a horizontal axis relative to the main body support section 15. Applicant's U.S. Pat. No. 4,649,905 and the present invention provide a wide variety of relative motions or degrees of freedom to the headpiece 19 relative to the main body support section 15. These motions, of course, may be employed in any practitioner-selected combination but will, for clarity, be discussed individually.

Figure 11:
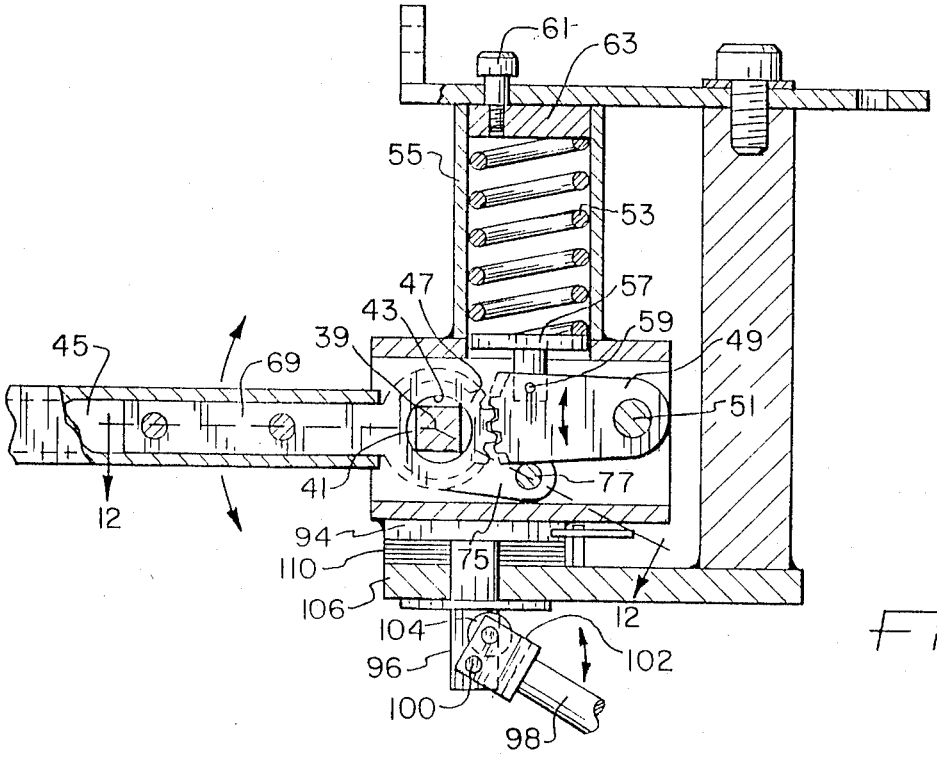
FIG. 11 is a fragmentary, cross-sectional view, the plane of the section being indicated by the line 11—11 in FIG. 4.
Figure 12:
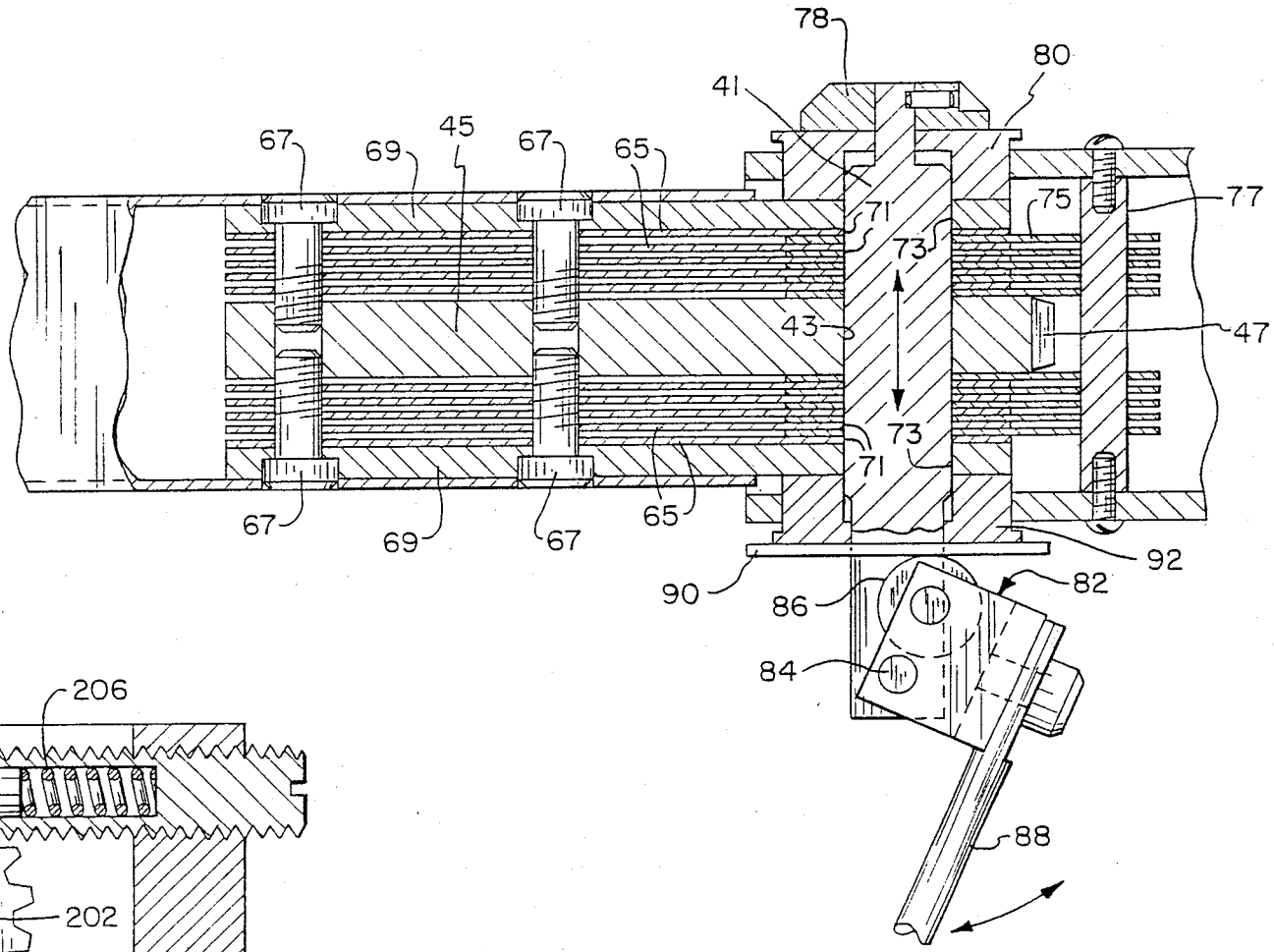
FIG. 12 is a cross-sectional view, the plane of the section being indicated by the line 12—12 in FIG. 11.

Cervical spine flexion in the form of an up-and-down headpiece pivotal motion about the horizontal axis 39 is best seen in FIG. 11, with certain details thereof illustrated in FIG. 12. The horizontal axis 39 is coaxial with that of a pin 41 which is slidably and rotatably received in a bore 43 provided in one end of a headpiece support bar 45. The end of the support bar 45 through which the pin 41 passes is formed as a gear 47 which meshes with a toothed link 49 that is pivoted about a pin 51. The headpiece support bar 45 is counterbalanced in a clockwise direction as viewed in FIG. 11 by a compression spring 53 mounted in a cylinder 55 which exerts a downward force on a piston 57 which is pinned to the link 49 by a pin 59.

The bar 45 may be locked in any one of a number of preselected, rotated positions about the axis 39 by a clamping mechanism which includes a plurality of hinged leaf plates 65 which are provided on the sides of the support bar 45 and fixed thereto by bolts 67. The bolts 67 are threaded into the support bar 45, but permit axial movement of the plates 65 relative thereto and axial movement of side-retaining plates 69 relative thereto. The pin 41 passes through apertures 71 in the plates 65, and also through apertures 73 in the retaining plates 69. A plurality of hinge plates 75 are loosely mounted on a cross pin 77 for axial movement relative to the pin and are interleaved with the plates 65 and, like the plates 65, slidably receive the pin 41.

The pin 41 is provided with an end cap 78 which bears against a thrust receiving cap 80. The other end of the pin 41 projects outwardly and has cam lock mechanism 82 pivoted thereto by a pin 84. The cam lock mechanism 82 includes a cam roller 86 which, upon movement of a flexion lock handle 88 in a counterclockwise direction, is adapted to bear against an end cap 90 and draw the pin 41 downwardly, as viewed in FIG. 12, to thereby cause the thrust plate 80 and a thrust plate 92 to clamp the interleaved plates 65 and 75 together to securely lock the support bar 45 in a preselected position.

The articulate coupling between the headpiece 19 and the main body support section 15, in addition to providing the above-discussed vertical traction of the headpiece, also provides a lateral traction or side-to-side motion for the headpiece 19, generally about a vertical axis of a mounting plate 94. The mounting plate 94 has a projection 96 to which a lateral bend lock handle 98 is pivoted by a pin 100. The lock handle 98 carries a cam locking mechanism 102 which includes a cam roller 104 which, upon counterclockwise movement of the handle 98, draws the supporting base 94 downwardly toward a support shelf 106 fixed to the main body support section 15 by a pin 108. The base 94 rests on a plurality of washers 110 which permit the bar 45 to be rotated in a horizontal plane and which will lock the bar 45 in a preselected position upon movement of the handle 98 in a counterclockwise direction.

The headpiece support bar 45 projects through the headpiece 19 and is provided with a handle 112 to enable the doctor to position the headpiece 19 relative to the main body support section 15. A traction mode of motion is also available to the practitioner in which the headpiece 19 is movable linearly and generally horizontally along the headpiece support bar 45. As may be seen in FIG. 5, the support bar 45 extends between a traction lock housing 114 and a front end plate carriage 116. The mounting bar 45 also is slidably received by a rear end plate carriage 118. The end plate carriages 116 and 118, and therefore the headpiece 19, may be positioned along the support bar 45 and then locked thereto by a tapered wedge block 120 (FIG. 6) which coacts between the traction lock housing 114 and the bar 45 by sliding along an upwardly tapered floor 122 in the housing 114. The upper surface 124 of the block 120 has a similar taper so that upon movement of the block 120 along the floor, the surface 124 will remain parallel to the surface of the bar 45 and will apply an interference to movement of the headpiece 19 along the bar 45 to lock the headpiece 19 in a preselected position. The block 120 is moved by an eccentric pin 126 which engages a recess 128 in the block 120 and the pin 126 projects from a traction block handle 130.

During chiropractic treatment of cervical problems, it is frequently desirable to impart a twisting or rotational motion to the patient's head. Such twisting motion should be generally about an axis corresponding generally to the axis of the patient's spinal column. Thus, in effect, a pure rotational movement is effected between adjacent vertebra of the cervical spine portion. The arrangement for achieving this rotation about the spinal cord will now be described.

A patient's head faces downwardly and rests on the cushions 37, and the patient's spinal cord axis is generally indicated at 132.

The headpiece, and in particular the cushions 37, are connected to the support bar 45 by an arrangement which allows limited arcuate movement of the headpiece about the axis 132, but without, of course, any direct coupling between the headpiece and the axis 132. This coupling arrangement includes a carriage 134, which comprises a rectangular box. The carriage 134 is fixed to front and rear end plates 136 and 138, respectively. The end plates 136 and 138 are rotatably mounted on the front and rear end plate carriages 116 and 118 by means of rollers 140. An auxiliary roller 142 is provided on a rotational lock housing 144 to coact with an arcuate slot 146 in the end plate 136.

Figure 5:
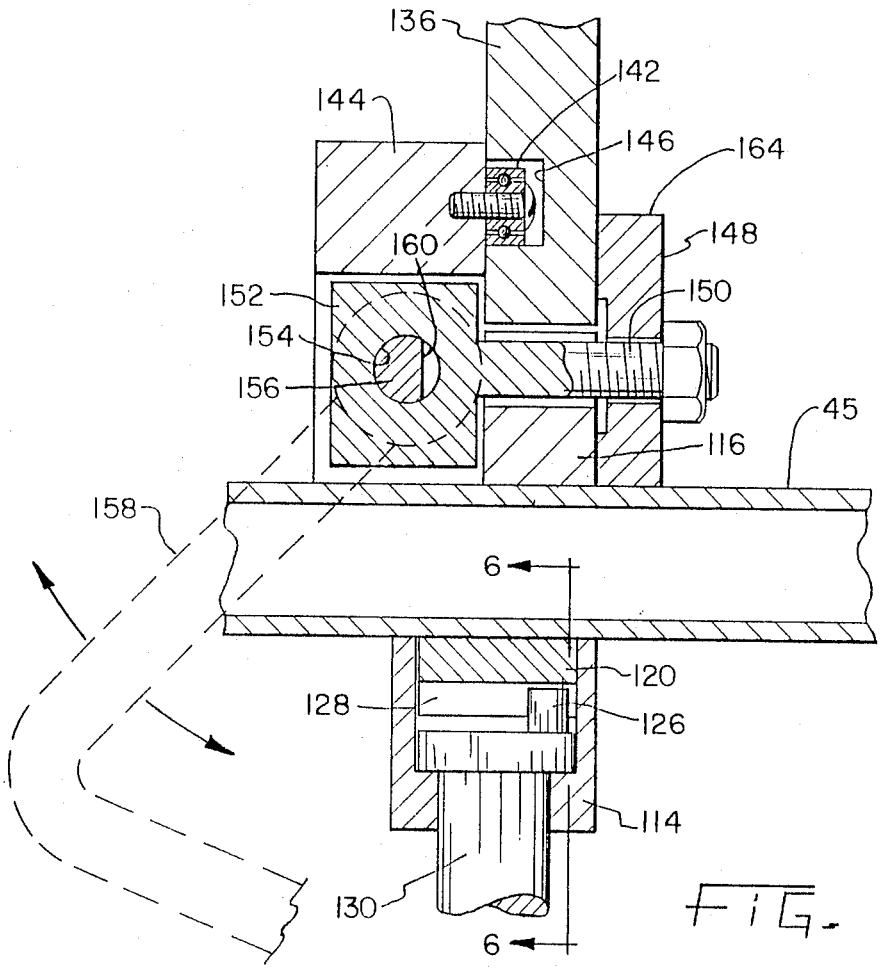
FIG. 5 is a fragmentary, cross-sectional view, the plane of the section being indicated by the line 5—5 in FIG. 2.
Figure 6:
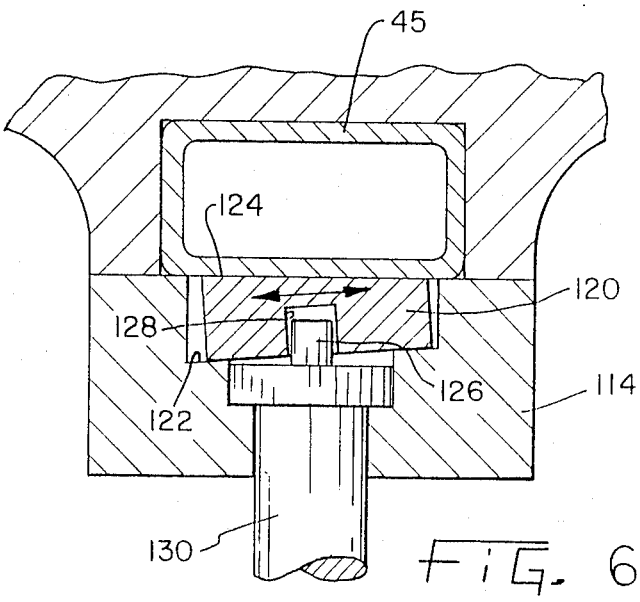
FIG. 6 is a cross-sectional view, the plane of the section being indicated by the line 6—6 in FIG. 5.

The end plates 136 and 138, and therefore the headpiece 19, may be rotated to a preselected position and locked in that position by means of a locking device. The locking device includes a rotation lock clamp 148 loosely mounted on a rotation lock bolt 150, which projects as a portion of a rotational lock body 152 between the end plate 136 and the end carriage 116. The body 152 has a bore 154 therein, which carries a cam lock bar 156 associated with a rotation lock handle 158. The bar 156 has a relieved portion 160. The locking arrangement shown in FIG. 5 is in a locking condition, with the lock clamp 148 drawn against the end plate 136. When the handle 158 is rotated upwardly in a counterclockwise direction, the relieved portion 160 permits movement of the block 152 to the right, as viewed in FIG. 5, to release the pressure exerted by the clamp 148 on the end plate 136. The rotated position in degrees may be provided on the end plate as visible indicia 162 and a pointer 164 which is an extension of the block 148.

Figure 7:
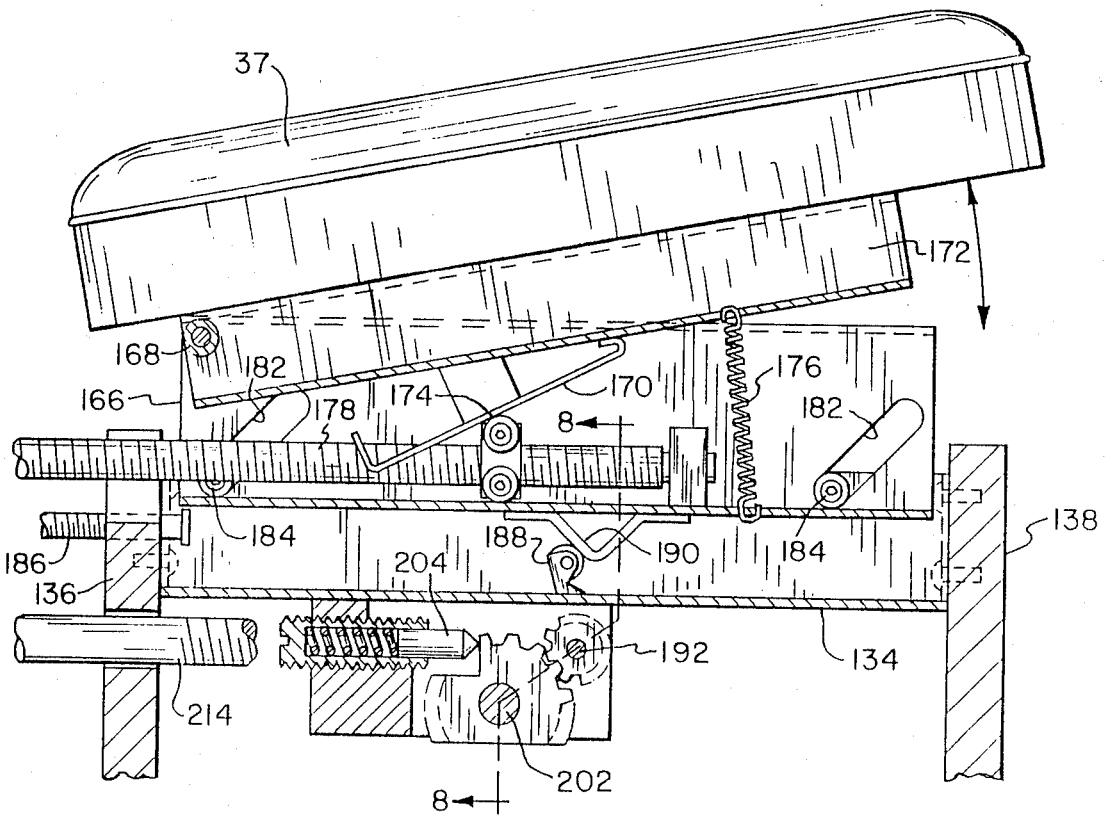
FIG. 7 is a fragmentary, elevational view of a portion of the headpiece, partially in section, to show details of construction.

An additional degree of freedom is provided in the headpiece which supplies auxiliary flexion to the headpiece. Referring to FIG. 7, the cushions 37 are pivoted to a carriage 166 at a pivot connection 168. A camp 170 is fixed to a cushion support frame 172 and rests on a roller assembly 174. A tension spring 176 biases the ramp 170 into contact with the roller assembly 174. The cushions 37 may be adjusted upwardly from a horizontal position by moving the roller assembly 174 to the left as viewed in FIG. 7. The roller assembly 174 is threadedly mounted on an auxiliary flexion adjustment shaft 178 having an adjusting knob 180.

A further degree of freedom of headpiece movement is made available to the practitioner in the form of a so-called drop or abrupt downward translation of the headpiece away from the main body support portion 15 by employing a triggered detent arrangement.

Figure 10:
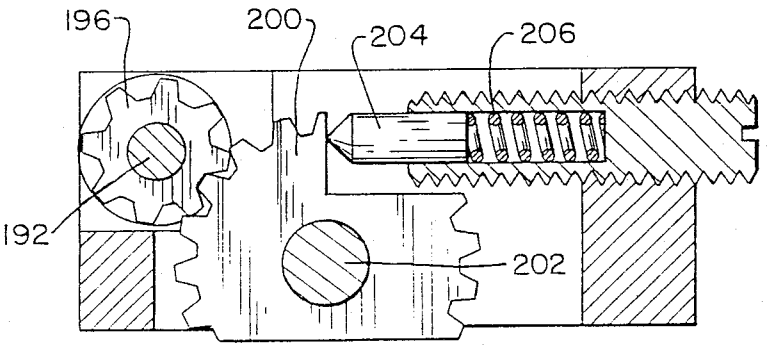
FIG. 10 is a cross-sectional view, the plane of the section being indicated by the line 10—10 in FIG. 8.

Referring particularly to FIGS. 7 and 10, it may be noted that the carriage 166 is carried by the carriage 134, and that the carrige 166 is provided with oblique slots 182 which coact with rollers 184 fixed to the carriage 134, so that the carriage 166 is movable in an oblique path relative to the carriage 134 between the raised position illustrated in FIG. 7 and a lowered or dropped position wherein the carriage 166 abuts an adjustable stop 186.

Figure 8:
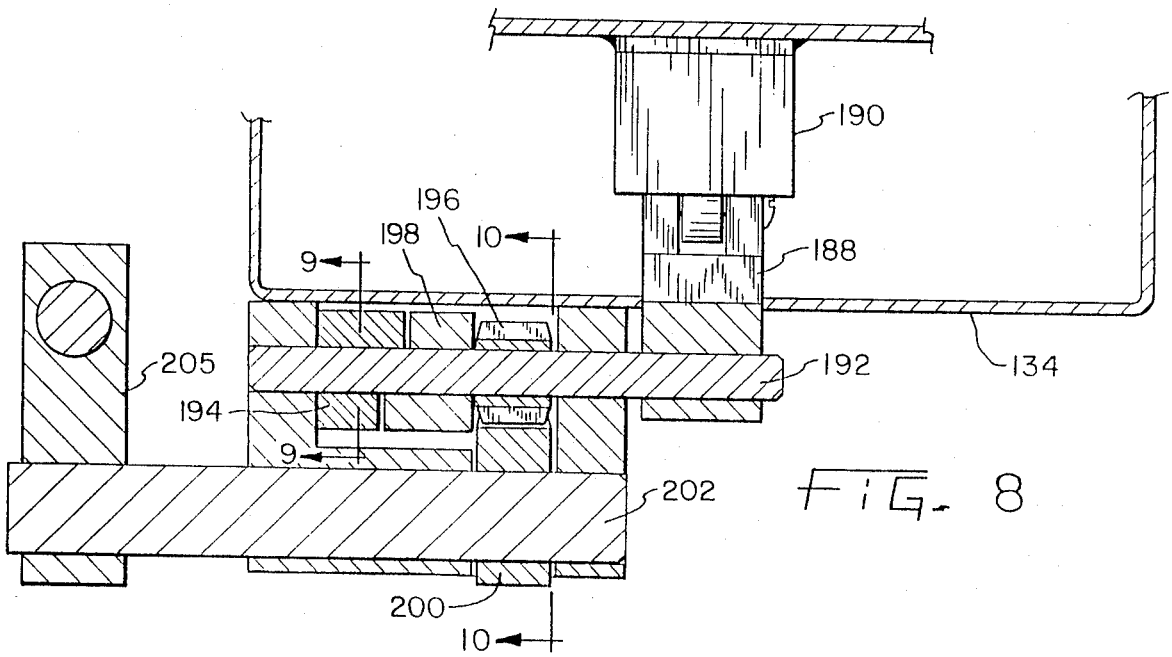
FIG. 8 is a fragmentary, cross-sectional view, the plane of the section being indicated by the line 8—8 in FIG. 7.

The carriage 166 is held in its raised or cocked position by a roller 188 which engages a ramp 190 fixed to the bottom of the carriage 166. The roller 188 is adapted to release the carriage 166 from its raised position upon the application of a predetermined pressure thereto exerted on the roller 188 by pressure on the cushion 37. To this end, and referring to FIG. 8, it may be noted that the roller 188 is fixed to a shaft 192 at one end thereof and the other end of the shaft 192 has a driven clutch 194 fixed thereto. Rotatably mounted on the shaft 192 is a combination driven pinion gear 196 and drive clutch 198 which is formed as a unitary assembly. A drive gear 200 meshes with the spur gear 196 and is fixed to a shaft 202 to be driven thereby and is biased by a plunger 204 (FIG. 10) and a compression spring 206 in a direction of rotation which will disengage the drive clutch 198 from driving engagement with the driven clutch 194. Rotation of the shaft 202 is accomplished by a cocking lever bracket 205 which is associated with a cocking lever handle 206.

Figure 9:
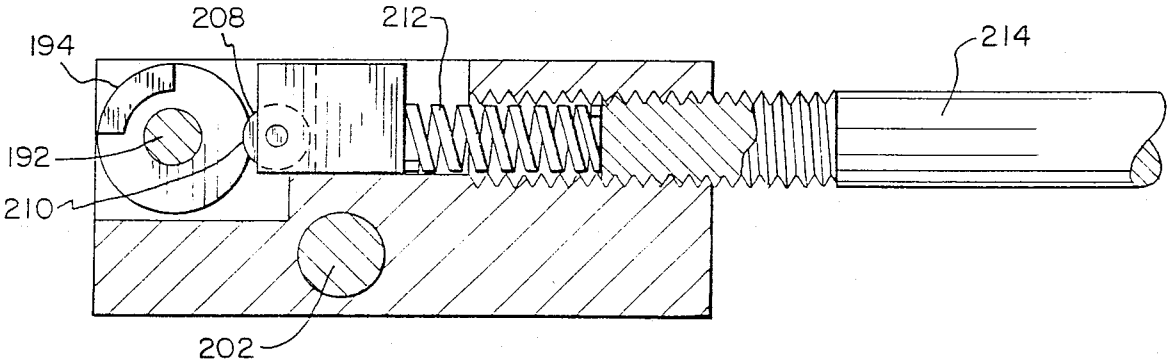
FIG. 9 is a cross-sectional view, the plane of the section being indicated by the line 9—9 in FIG. 8.
Figure 2:
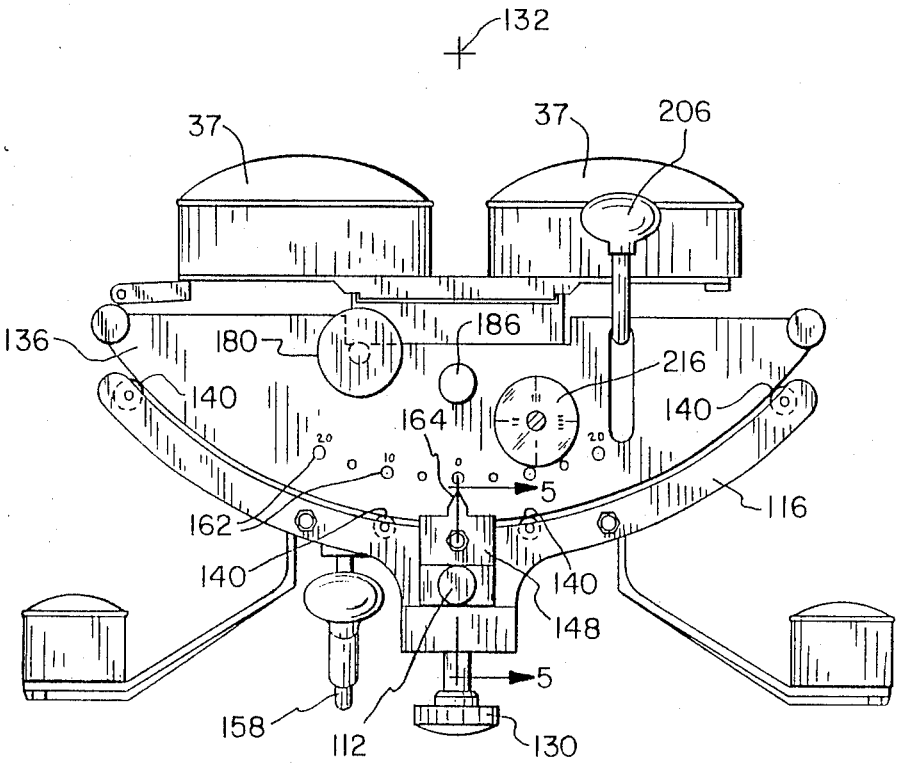
FIG. 2 is an end elevational view of the headpiece portion of the table.
Figure 3:
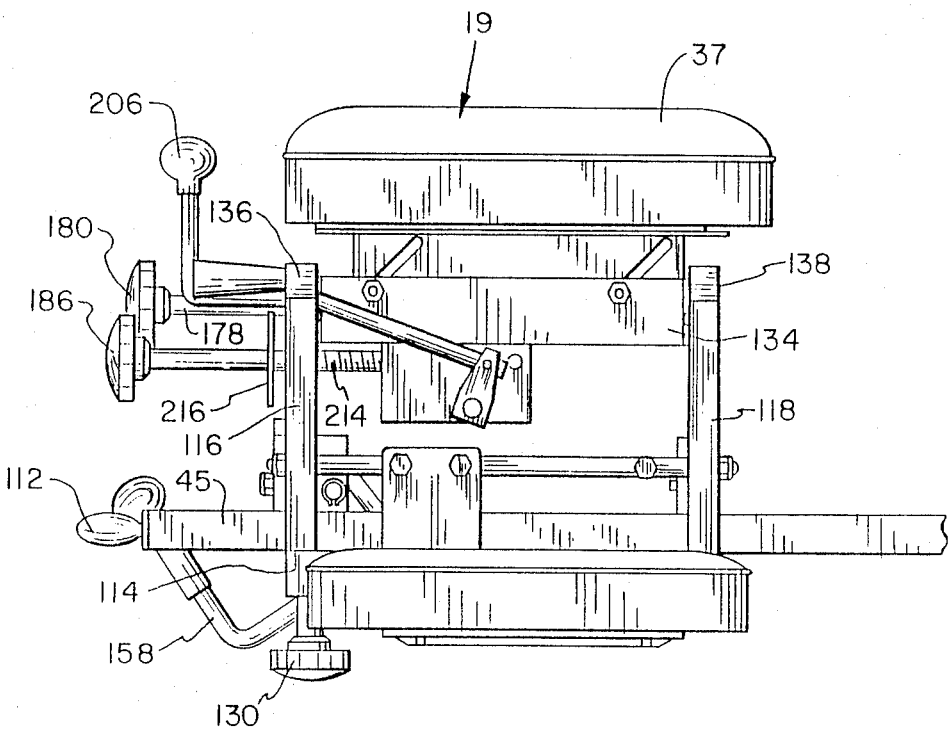
FIG. 3 is a side elevational view of the headpiece portion of the table.
Figure 4:
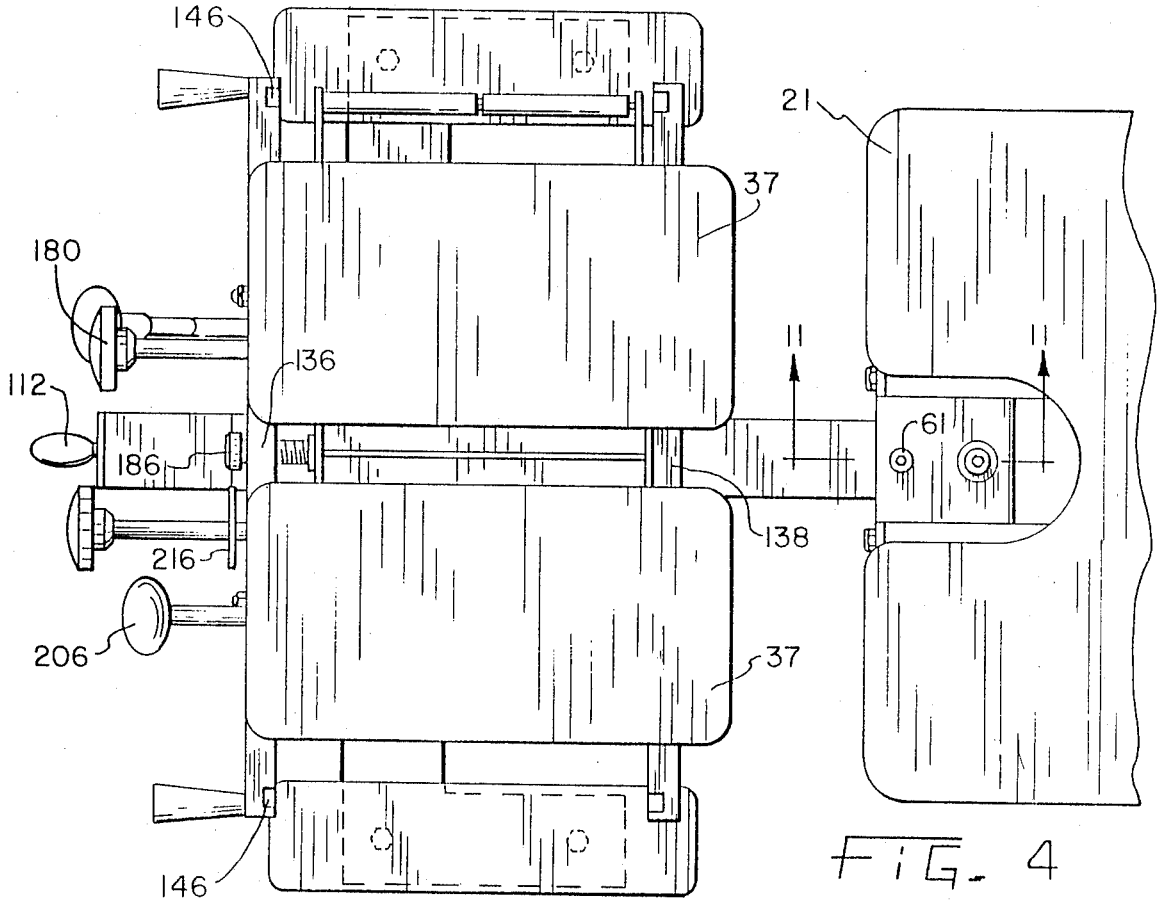
FIG. 4 is a plan view of the headpiece portion of the table.

A downward movement of the cocking lever handle 206, as viewed in FIGS. 1 through 3, causes the drive gear 200 to rotate the driven gear 196 and its associated drive clutch 198 in a direction which drives the driven clutch 194, and therefore the shaft 192 and the roller 188, to lift the carriage 166 to the position illustrated in FIG. 7. When the carriage 166 reaches its raised position, a ball detent 208 (FIG. 9) registers with a recess 210 in the surface of the driven clutch 194. The force exerted by the detent 208 is determined by a tension adjustment spring 212 which is adjustably compressed by a threaded shaft 214 having an adjusting knob 216 at its end.

When the detent 208 engages the recess 210 and the operator releases the handle 206, the plunger 204 causes the drive clutch 198, the gear 196, and the handle 206 to back off out of driving engagement with the nowlocked, driven clutch 194. The pressure on the roller 188, which is sufficient to overcome the force of the spring 212, is therefore fully dependent on the pressure of the engagement of the detent 208 independent of the cocking mechanism.

The practitioner may "pre-tune" the drop to the force applied by him independent of the weight of the patient's head by cocking the headpiece 19 in the foregoing manner, with the patient's head resting naturally on the cushions 37. The practitioner would then relieve the tension of the adjusting spring 212 by turning the knob 216 until the weight of the patient's head released the detent 208. The practitioner would then increase the tension on the spring 212 by turning the knob 216 a predetermined number of turns, e.g., two turns. The practitioner would then be assured that the detent would release to perform the drop independent of the weight of the individual patient's head and the function of his own exertion. It should further be noted that the drop may be accomplished while the headpiece is in a rotated position and in a direction corresponding to the direction that the patient's head is facing.

The extent of the drop may be varied by adjusting the adjustable stop inwardly or outwardly to control the amount of travel of the carriage 166 obliquely downwardly along the rollers 184.

From the foregoing, it is now apparent that a novel, articulate coupling between a headpiece and a main body support section of a chiropractic treatment table, allowing a wide variety of practitioner-induced movements, has been disclosed, meeting the objects and advantageous features set out hereinbefore, as well as others, and that modifications as to the precise configuration, shape, and details may be made by those having ordinary skill in the art without departing from the spirit of the invention or the scope thereof as set out by the claims which follow.

What is claimed is:

1. In a chiropractic treatment table of the type having a support pedestal, an upper body support section resting on the support pedestal, an anterior portion extending from the support section for supporting a lower portion of a patient's body, and a headpiece extending from the support section in a direction generally opposite the anterior portion and upon which a patient's head may rest with the patient in a prone position spanning the headpiece, support section, and anterior portion, the improvement comprising means for provding arcuate movement of said headpiece about a cervical axis spaced above the plane of the table and parallel to a longitudinal axis of the table and for locking said headpiece in any one of a multiplicity of positions along an arc, and means for providing at least two additional degrees of freedom for said headpiece toward and away from said cervical axis and in a direction located in a plane normal to said headpiece and passing through said cervical axis when said headpiece is in any one of its said positions.

2. The improvement according to claim 1, wherein one of said degrees of freedom is arcuate about an axis passing through said headpiece.

3. The improvement according to claim 2, wherein the other one of said degrees of freedom is rectilinear.

4. The improvement according to claim 3, wherein the direction of said other one of said degrees of freedom is oblique relative to said longitudinal axis.

5. The improvement according to claim 1, wherein one of said additional degrees of freedom is rectilinear between first and second positions and means for releasably locking the headpiece in said first position.

6. The improvement according to claim 5, wherein the means for releasably locking said headpiece includes pressure-responsive locking means to release said headpiece upon the application of a predetermined pressure to said headpiece.

7. The improvement according to claim 6, wherein said locking means is adjustable to release said headpiece at any one of a multiplicity of preselected pressures.

8. The improvement according to claim 5, wherein said second position includes a stop means to limit the rectilinear extent of said one of said additional degrees of freedom and wherein the stop means is adjustable to vary said rectilinear extent.

9. The improvement of claim 1 comprising means articulately coupling the headpiece to the support section and selectively providing relative thereto said at least two additional degrees of freedom of headpiece movement.

10. The improvement of claim 9, wherein the articulate coupling provides pivotal motion of the headpiece selectively about a generally horizontal axis and about a generally vertical axis.

11. The improvement of claim 9, further comprising an elongated headpiece support bar, the articulate coupling means pivotally interconnecting the bar and support section, and means for selectively moving the headpiece linearly along the support bar providing a traction mode of patient treatment.

12. In a chiropractic treatment table of the type having a support pedestal, an upper body support section resting on the support pedestal, an anterior portion extending from the support section for supporting a lower portion of a patient's body, and a headpiece extending from the support section in a direction generally opposite the anterior portion and upon which a patient's head may rest with the patient in a prone position spanning the headpiece, support section, and anterior portion, the improvement wherein said headpiece includes end plate means comprising a first carriage mounted on said support section and defining an arcuate track, means comprising a second carriage mounted on end plate means for arcuate movement along said track, means comprising third carriage means mounted on said second carriage for rectilinear movement between first and second positions with respect to said second carriage, and fourth carriage means pivotally connected to said third carriage means for arcuate movement relative to said third carriage means.

13. The improvement according to claim 12, wherein said third carriage means is movable in a rectilinear path which is oblique with respect to a longitudinal axis of said treatment table.

14. The improvement according to claim 13, including means to releasably lock said third carriage means in said first position.

15. The improvement according to claim 14, wherein the locking means is pressure-responsive to release said third carriage means upon the application of a predetermined pressure thereto.

16. The improvement according to claim 15, wherein said locking means includes adjustable release means for releasing said third carriage at any one of a multiplicity of preselected pressures.

17. The improvement according to claim 16, wherein said second position includes a stop means to limit the extent of said rectilinear path and wherein the stop means is adjustable to vary said extent.

18. The improvement according to claim 17, including means to cock said third carriage by moving said carriage from said second position to said first position.

19. The improvement according to claim 18, wherein said means to cock said third carriage includes a first shaft pivotally mounted on said second carriage, a drive cocking roller fixed to said first shaft and bearing against a lower portion of said third carriage to lift said third carriage from said second position to said first position upon rotation of said first shaft, a first gear rotatably mounted on said first shaft and having a one-way drive clutch portion associated therewith, a one-way driven clutch fixed to said shaft and being adapted to rotate said shaft in a first direction upon engagement by said drive clutch, an additional shaft having a second gear fixed thereto and engaging said first gear, said locking means comprising a recess in said driven clutch and a detent plunger releasably engaging said recess when said third carriage is in its first position, lever means for rotating said second shaft to thereby rotate said second and first gears and said drive and driven clutches and to thereby rotate said first shaft and the drive cocking roller fixed thereto in a first direction to lift said third carriage.

20. The improvement according to claim 19, wherein said adjustable release means includes a spring biasing said detent into said recess and means to vary the spring pressure against said detent.

21. The improvement according to claim 19, including means for biasing said second gear in a second direction so that the drive clutch is released from the driven clutch when the driven clutch is retained in a cocked position by said detent.

* * * * *